US006871767B2

(12) United States Patent
Perlman et al.

(10) Patent No.: US 6,871,767 B2
(45) Date of Patent: Mar. 29, 2005

(54) MARKER PEN HOLDER

(75) Inventors: Daniel Perlman, Arlington, MA (US); Francis Gomes, Jersey City, NJ (US)

(73) Assignee: Bel-Art Products. Inc., Pequannock, NJ (US)

( * ) Notice: Subject to any disclaimer, the term of this patent is extended or adjusted under 35 U.S.C. 154(b) by 76 days.

(21) Appl. No.: 10/256,895

(22) Filed: Sep. 27, 2002

(65) Prior Publication Data

US 2004/0060952 A1 Apr. 1, 2004

(51) Int. Cl.[7] ..... A45F 5/00

(52) U.S. Cl. ..... 224/269; 206/214; 24/11 R; 401/202

(58) Field of Search ..... 224/666, 679, 224/681, 269; 24/11 R, 11 FE, 11 CT, 11 HC, 11 P, 10 R, 12; 401/243, 202; 206/214, 224, 371, 443; 211/69.1, 69.5, 69.8, 69.9

(56) References Cited

U.S. PATENT DOCUMENTS 1,377,097 A * 5/1921 Seaton ..... 24/11 CT
2,415,208 A * 2/1947 Greenberg ..... 224/242
4,151,937 A * 5/1979 Jarosh et al. ..... 224/666
4,189,048 A * 2/1980 Gaillard ..... 206/372
4,573,818 A * 3/1986 Kodera ..... 24/11 R
4,773,544 A * 9/1988 McCarthy ..... 206/214
D325,686 S 4/1992 Ancona et al.
5,163,549 A 11/1992 Hayduchok
5,388,741 A * 2/1995 Hillinger ..... 224/679
D383,495 S 9/1997 Mollet
5,907,584 A * 5/1999 Leveque ..... 375/296
D414,210 S 9/1999 Davis
5,988,369 A * 11/1999 Hsu ..... 206/214
6,202,862 B1 3/2001 Acquaviva et al.
6,257,539 B1 7/2001 Pelaez
6,626,334 B2 * 9/2003 Ewing ..... 24/11 R

* cited by examiner

*Primary Examiner*—Nathan J. Newhouse
(74) *Attorney, Agent, or Firm*—Lawrence G. Fridman

(57) ABSTRACT

A marker pen supporting and holding device includes a cavity for capturing a marker pen cap therein consisting of principal and auxiliary cavity portions. The principal cavity portion is provided for receiving a protective cap body and the auxiliary cavity portion is provided for guiding and captivating a marker cap pocket attachment clip. A securing pin extends through aligned device body apertures to traverse a gap between the cap body and the pocket attachment clip, thereby removably securing the cap within the device to enable one-handed marker pen handling.

20 Claims, 7 Drawing Sheets

MARKER PEN HOLDER

BACKGROUND OF THE INVENTION

1. Field of the Invention

The present invention relates generally to holders for marking implements and, more particularly, to a device constructed to support and releasably retain the cap portion of marking pens.

2. Description of the Prior Art

There is a substantial prior art including many patents that describe holding devices for pens, pencils and other marking implements. Among these are many patents concerned with protecting pen tips, and preventing the ink in these tips from drying out prematurely. Some patents describe holding devices for protecting pen tips that otherwise would be exposed to the ambient air. U.S. Pat. No. 6,257,539 to Pelaez and U.S. Pat. No. 6,202,862 to Acquaviva, et al. are exemplary of such devices. Other patents describe pen-holding devices that incorporate the protective cap originally provided with the pen. U.S. Pat. No. 5,163,549 to Hayduchok discloses one such device wherein the marking pen caps remain captive within device sockets when the pens are removed.

Typically manufactured permanent marking pens include a sealing cap that prevents evaporation of the volatile solvents contained in the marking ink. Removing the sealing cap from such marking pens is generally an operation which requires utilization of two hands of a user. U.S. Pat. No. 6,202,862 by Acquaviva, et al. includes an extensive review of pen holding devices, including some that facilitate one-handed operation of the pen, while still protecting the pen tip and ink. However, some of these devices are quite complex and relatively expensive. Thus, there is a need for a simple and reliable holding device for a marking pen and its protective sealing cap requiring utilization of one hand of a user.

SUMMARY OF THE INVENTION

The invention is directed to a supporting and holding device for at least one marking pen and its sealing cap, in which the sealing cap includes a pocket attachment clip that allows the cap portion of the pen to be removably retained, or locked, within the holding device.

In one general aspect of the present invention, a main device body is provided having a longitudinally extending cavity sized and shaped for receiving the cap portion of a writing implement. The cavity includes a principal cavity portion for receiving the marker cap body, and an adjoining auxiliary cavity portion, or channel adapted for receiving the attachment clip portion of the marker cap is received. The auxiliary cavity portion captures the marker cap attachment clip such that rotation of the cap about its longitudinal axis is restricted, thereby maintaining the cap in a desired orientation. A cap retention arrangement is provided for releasably holding, or retaining, the marker cap within the cavity. An attachment arrangement is provided for facilitating temporary or permanent attachment of the device to a supporting structure or surface.

In another aspect of the present invention, retention of the marker cap within the cavity is accomplished using an arresting pin inserted through an aperture in a sidewall of the main body such that the arresting pin traverses the space between an outer surface of the marker cap and the marker cap attachment clip.

In still another aspect of the present invention, the position of the arresting pin is adjustable along the longitudinal axis of the cap to accommodate varying marking cap and pocket attachment clip configurations.

In yet another aspect of the present invention, retention of the marker cap within the cavity is accomplished by using a resilient insert at least partially lining the cavity and configured for frictionally engaging the marker cap.

In a further aspect of the present invention, the device is adapted for supporting and holding a plurality of markers having mating caps including pocket attachment clips. The device features front and rear bodies adjustably secured to each other by clamping arrangement and cooperating to define a plurality of marker cap receiving cavities therebetween. In this aspect of the invention, resilient inserts are preferably provided at least partially lining the cavities such that the resilient linings frictionally engage the respective marker caps to capture the caps therein.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the figures, the present invention features a supporting and holding device for at least one marking pen and its sealing protective cap. The device is particularly suited for use with marking pens having sealing caps including a pocket attachment clip, which construction is quite typical. The device features an arrangement for removably retaining, or locking, the marking cap within the device, as well as an attachment arrangement enabling the entire pen-holding device to be secured to a supporting surface or structure. Significantly, the device of the present invention facilitates single-handed handling of marking pens. That is, only one hand of a user is required to separate the pen from the cap. Likewise, reattachment of the pen and cap is a single-handed operation. Such handling is often highly desirable and, in fact, is particularly vital in many work environments. For example, such handling is commonly required in chemical and biological laboratories where scientists and researchers typically must dedicate one hand for use holding and/or manipulating objects such as laboratory ware, instruments, tools and the like.

Figure 1:
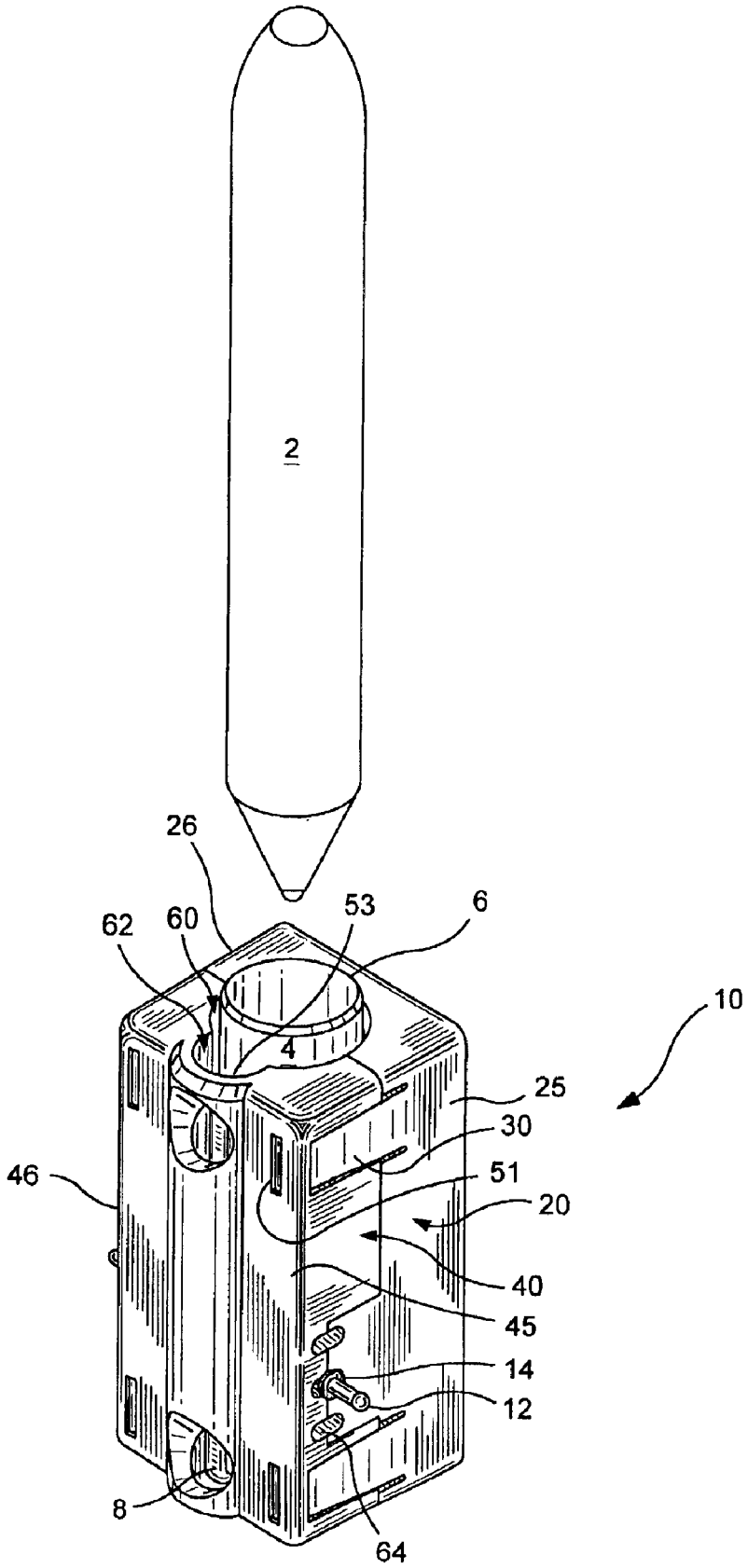
FIG. 1 is a perspective view of the marker pen supporting and holding device of the present invention shown fully assembled with the marker protective cap locked therein.
Figure 2:
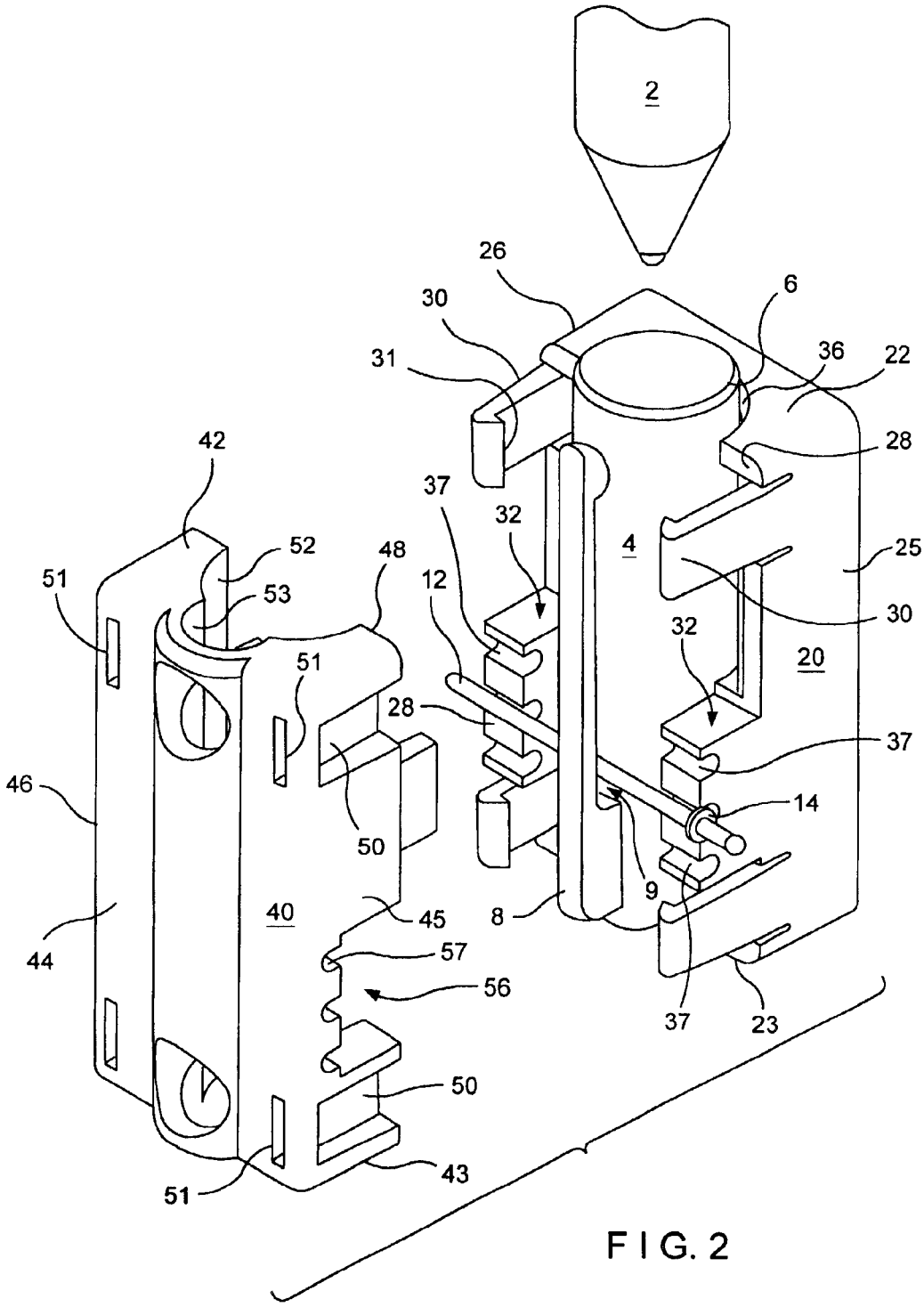
FIG. 2 is a perspective view of the marker pen supporting and holding device of FIG. 1, with the device body portions detached and separated to better illustrate the pen cap retention arrangement along with various interior structural features of the device body.
Figure 3:
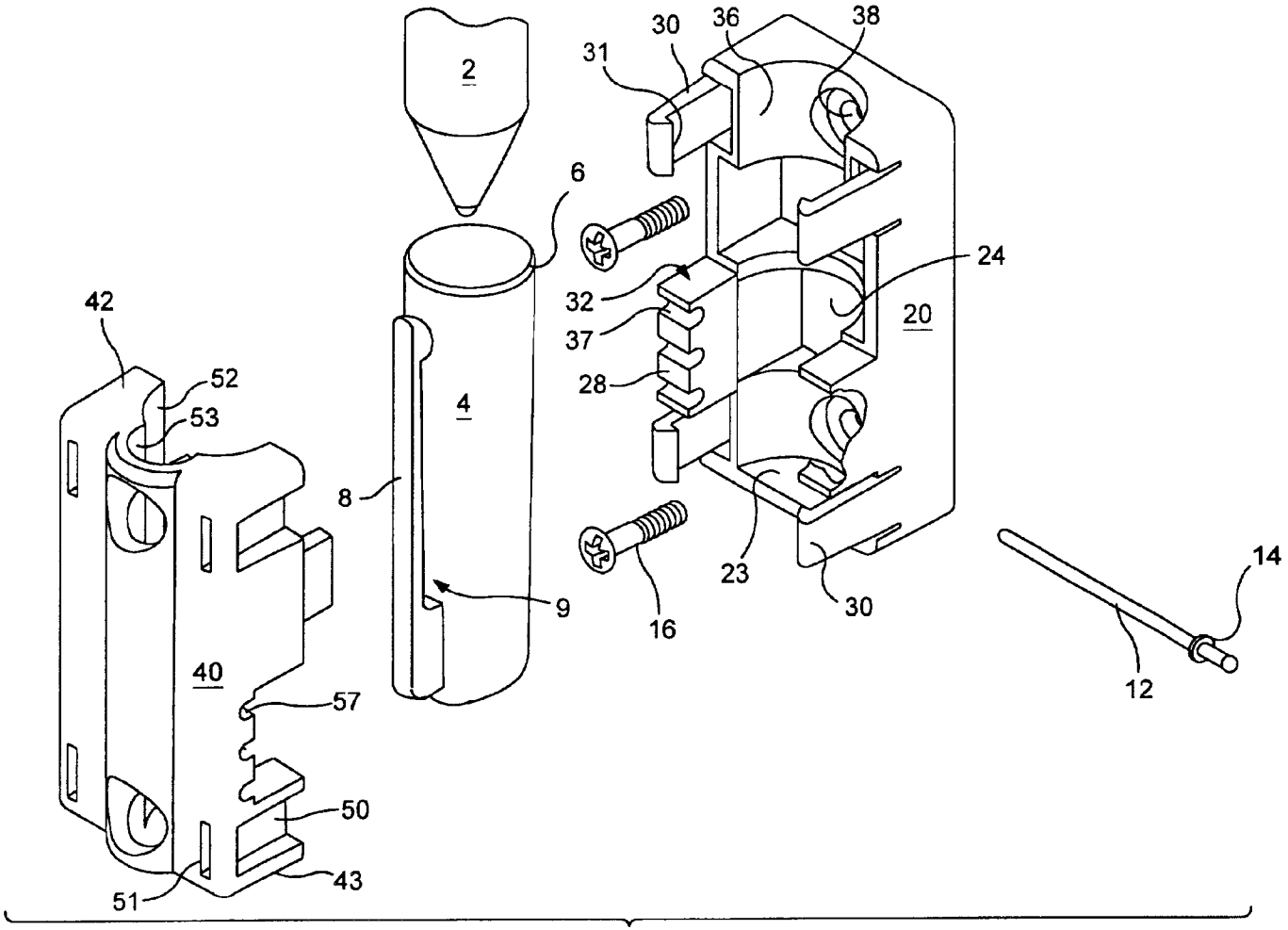
FIG. 3 is an exploded perspective view of the pen supporting and holding device of FIG. 1 oriented about a marker pen and cap assembly.
Figure 4:
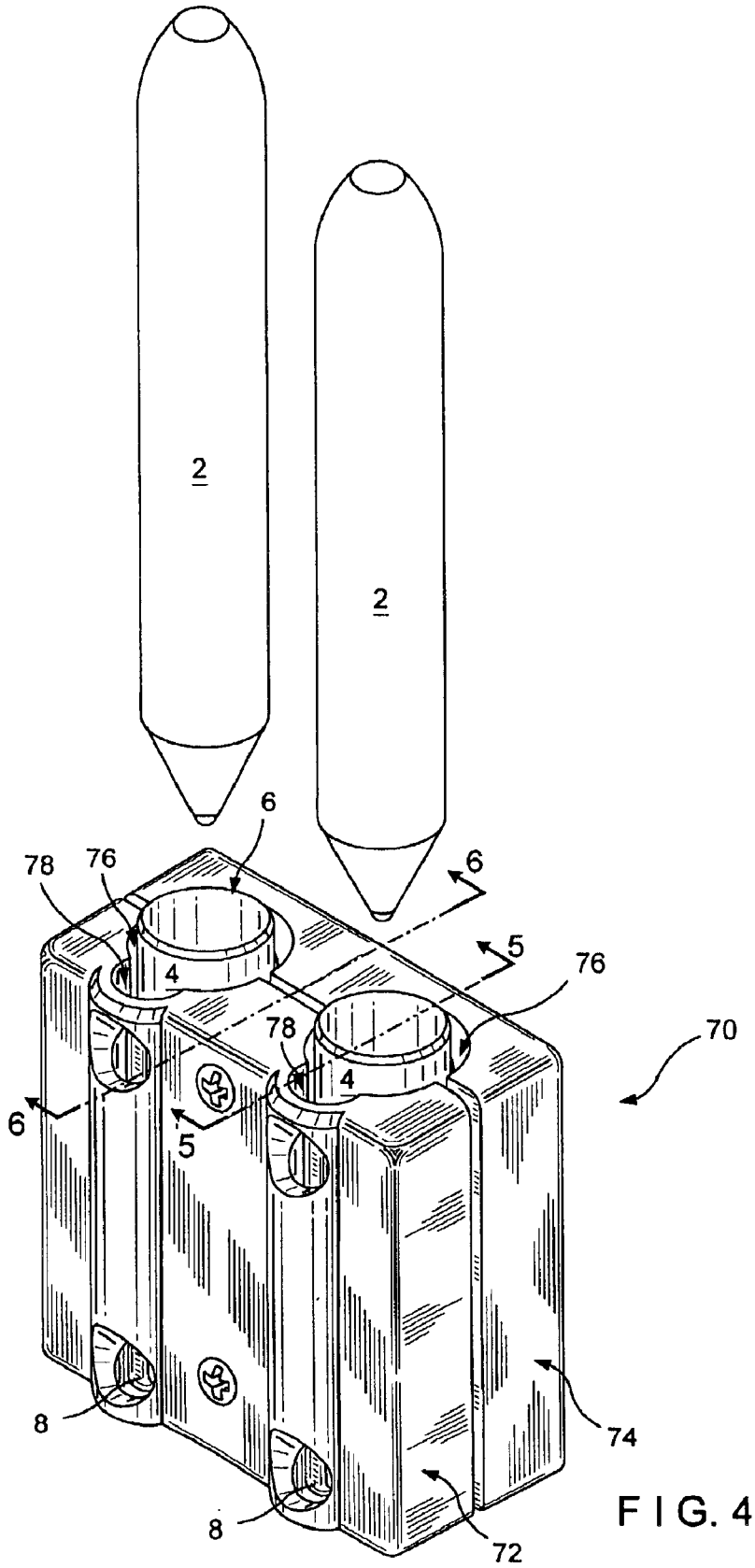
FIG. 4 is a perspective view of a multi-cavity marker pen supporting and holding device incorporating a two-part clamping mechanism in accordance with another aspect of the invention.

Referring initially to FIGS. 1–3, in one general aspect of the invention a device, shown generally by reference numeral 10, is provided for removably retaining a cap 4 of a marker pen 2 therein. The main structure of the device is comprised of a pair of main structural bodies 20 and 40 configured for snap-fitting attachment to each other during assembly. A first structural body 20 is generally defined by top side 22, bottom side 23, rear interior wall 24, and opposite sidewalls 25 and 26. Peripheral edges 28 facing the second body 40 extend between the top 22 and bottom 23 sides. A second main structural body 40 is generally defined by corresponding top side 42, bottom side 43, front wall 44, and opposite side walls 45 and 46. The first structural body 20 includes a plurality of semi-flexible integral snap fit tab members 30 extending outwardly along peripheral edges 28 and configured for engaging corresponding aligned side exterior recesses 50 and front exterior recesses 51 formed in body 40. Each tab member 30 is formed with an inwardly oriented tab catch portion 31 provided at a distal end thereof. More particularly, as the main structural bodies 20, 40 are brought together, the distal tab catch portions 31, while engaging the side exterior recess 50, cause tab members 30 to deflect outwardly until the tab catch portions snap-fittingly engage corresponding recesses 51. Although the snap-fit mechanism adapted for interconnecting the structural bodies 20 and 40 has been described hereinabove, it should be apparent to those skilled in the art that alternate snap fit and other conventional structures could be employed without departing from the scope of the invention.

The structural body 20 is formed with a curved recessed surface 36 extending along its longitudinal axis from the bottom side 23 through the entire length thereof. A similar recessed surface 52 is provided within the structural body 40. As best illustrated in FIGS. 2 and 3, a channel 53 is formed within structural body 40 and extends inwardly from and along the recessed surface 52. In the assembled condition of the device 10, recessed surface 36 of structural body 20 cooperates with corresponding recessed surface 52 formed in structural body 40 to define a principal cap-receiving cavity portion 60. Furthermore, an auxiliary cavity portion 62 is provided adjoining principal cavity portion 60, and otherwise bounded by channel 53. In operation the principal cavity portion 60 is adapted to receive protective cap 4, whereas the auxiliary cavity 62 is adapted for receiving marker cap attachment clip 8. Auxiliary cavity portion 62 serves two primary functions, the significance of which will now become apparent. First, cavity portion 62 acts as a cap insertion guide that ensures receipt and positioning of cap 4 within the holding device 10 in a predetermined desired orientation, so that the longitudinal axis of the cap is substantially parallel to or coincides with the longitudinal axis of the principal cavity portion 60. Second, auxiliary cavity bounding surface or channel 53 limits rotation of the cap 4 about its longitudinal axis, thereby maintaining the cap in the desired orientation following insertion into the holding device 10.

A series of spaced semicircular channels 37 are formed in thickened body portions 32 extending outwardly from opposite sidewalls 25 and 26 along peripheral edges 28 of structural body 20. Similar spaced semicircular channels 57 are provided within recessed portion 56 of side walls 45 and 46 of second structural body 40. As illustrated, for example, in FIGS. 1 and 2, when the two main structural bodies 20, 40 are brought together, the spaced semicircular channels 37 in body 20 cooperate with corresponding spaced semicircular channels 57 formed in body 40, to define a series of aligned aperture pairs 64 extending through opposite sides of the device.

A securing member or pin 12 is provided to extend through one of the pairs of aligned apertures 64. Significantly, each pair of aligned apertures 64 shares a central axis with a central axis of the securing member or pin 12 which is disposed traverse or at an angle to the longitudinal axes of primary cavity portion 60 and auxiliary cavity portion 62. A substantially perpendicular orientation of securing pin 12 relative to primary and auxiliary cavity portions is preferred. Furthermore, the relatively fixed orientation of marker cap 4 ensures that the central axis of each aperture pair also extends between an exterior surface of marker cap body 4 and pocket attachment clip 8. In this manner (see FIG.2 for example), as securing pin 12 traverses the space 9 between the marker cap body 4 and the marker cap pocket attachment clip 8, it is captured within this space. As a result, the marker cap body 4 is effectively locked within the principal cavity 60, enabling a person to pull the marking pen 2 away from the captivated marker cap 4. The series of spaced aperture pairs 64 enable positional adjustment of pin 12 within the space 9 and along the longitudinal axis of the cap 4. This arrangement enables accommodation within the holding device of marker pen caps having varying attachment clip locations vis-à-vis the marker cap body. Securing member or pin 12 preferably includes a flange 14 or equivalent stop mechanism which prevents uncontrollable insertion of the pin into the apertures 64.

In order to enable single-handed insertion of marker pen 2 into marker cap 4, and corresponding removal therefrom, the holding device 10 is preferably fixed to a conveniently accessible and non-movable supporting structure or surface, such as a shelf, bench or wall. Accordingly, structural body portion 20 can incorporate an attachment mechanism for this purpose. In this respect, one or more apertures 38 extending through rear wall 24 can be provided for facilitating attachment of the device to a wall or other surface using mechanical fasteners 16, such as screws and the like. However, as will be apparent to those skilled in the art, myriad alternative arrangements for affixing the holding device to a support structure or surface are possible including, for example, clip mechanisms, clamping mechanisms, magnets, adhesives, suction cups, and hook-and-loop type mating fabric fastening systems, to name just a few.

The preferred marking pen supporting and holding device of the present invention has been described as having a two-part snap-fit body structure. However, the invention is not intended to be so limiting. As will occur to those skilled in the art, the two mating structural body portions 20, 40 can be affixed to one another in a more permanent manner, for example, by means of mechanical fasteners, adhesives and the like. Furthermore, the main body of the present device can be manufactured as a unitary, or one-piece, molded structure. Additionally, although the essential elements of the invention such as main structural bodies 20 and 40 are preferably molded from plastic, the main body can be manufactured from other materials including metals.

As previously described, in the preferred embodiment of the present invention supporting and holding device 10 incorporates a pin-type arrangement for capturing the protective cap 4 within the device 10. However, alternate mechanical arrangements are contemplated for capturing and holding the protective marker cap body 4. For instance, the body of the device itself can squeeze or otherwise apply adequate pressure against marking cap body 4 and/or pocket attachment clip 8 to frictionally capture the cap within the device. Alternatively, the marker cap body 4 can be wedged into the device cavity. Furthermore, other friction holding arrangements adapted for holding the cap can be employed.

Referring now primarily to FIGS. 4–10, wherein another embodiment of the present invention in the form of a multi-cavity marker pen supporting and holding device 70 is provided. The device features front and rear body portions, 72 and 74, respectively, adjustably secured to each other by a clamping mechanism to define a plurality of marker cap receiving cavities therebetween. Preferably, each cap-receiving cavity includes a principal cavity portion 76 for receiving protective marking cap body 4 and an auxiliary cavity portion 78 for receiving pocket attachment clip 8, as previously described (with regard to FIGS. 1–3).

Figure 5:
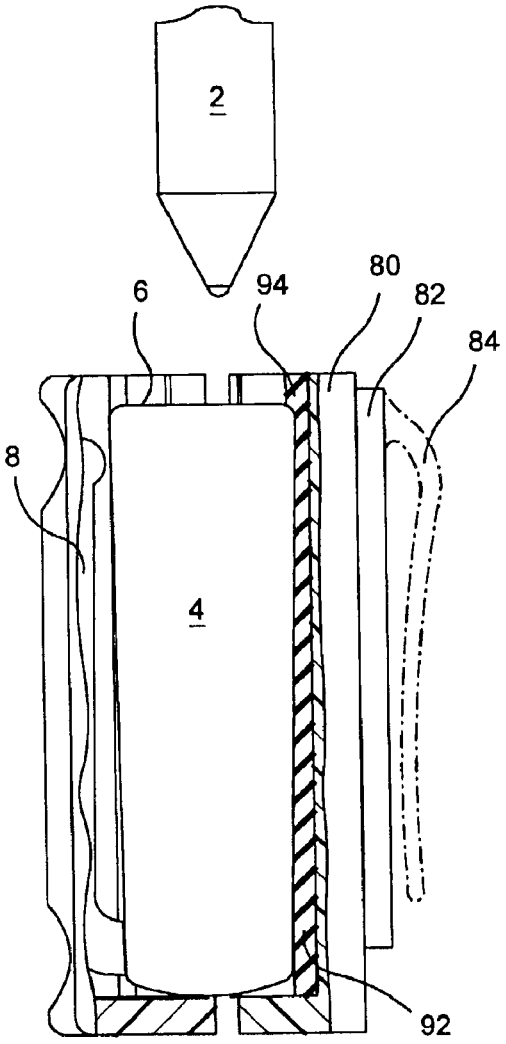
FIG. 5 is cross-section view taken along cutting plane 5—5 in FIG. 4, illustrating the inclusion of a resilient cavity lining in accordance with a further aspect of the present invention.
Figure 10:
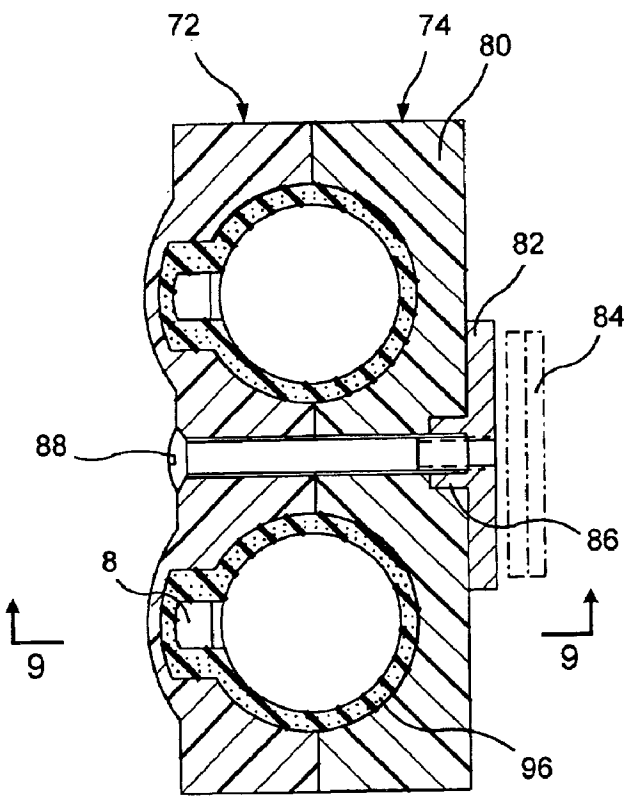
FIG. 10 is a cross-section view taken along cutting plane 10—10 in FIG. 9.

As best depicted in FIG. 5, it is preferred that a resilient insert 92 be provided at least partially lining the marker pen-receiving cavities for frictionally capturing and engaging the mating caps 4 within the cavities. Furthermore, a lip portion 94 is preferably provided extending over a peripheral edge 6 defining the marker-receiving cap opening and to further secure the cap 4 within the device 70. The resilient insert 92, see FIG. 8 for example, can be in the form of multiple segments disposed within the principal cavity portion 76 and extending at least partially through its length. Referring briefly to FIGS. 9–10, in another aspect of this embodiment of the invention, the resilient insert is comprised of a resilient sleeve 96 form-fitted to the holding device cavities. Resilient sleeve 96 can be provided within the principal cavity only or can extend into the auxiliary cavity portion as well. Again, resilient sleeve 96 preferably includes a lip portion 98 extending over marker cap peripheral edge 6.

Figure 6:
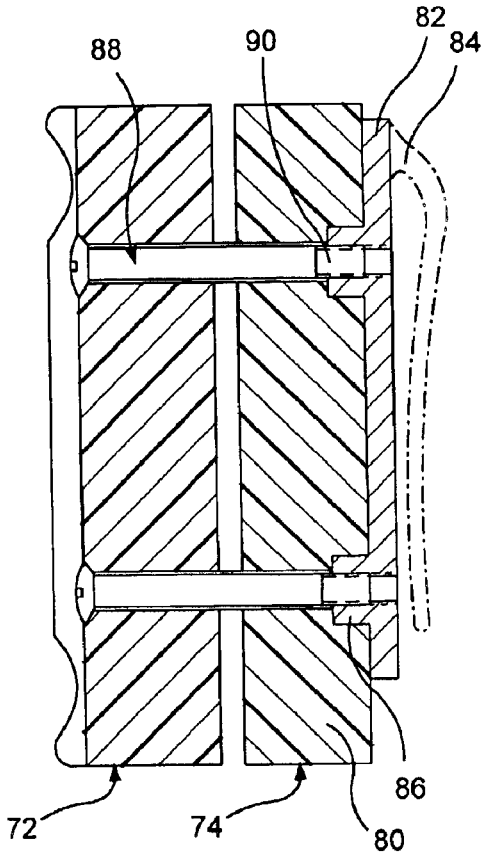
FIG. 6 is cross-section view taken along cutting plane 6—6 in FIG. 4.
Figure 7:
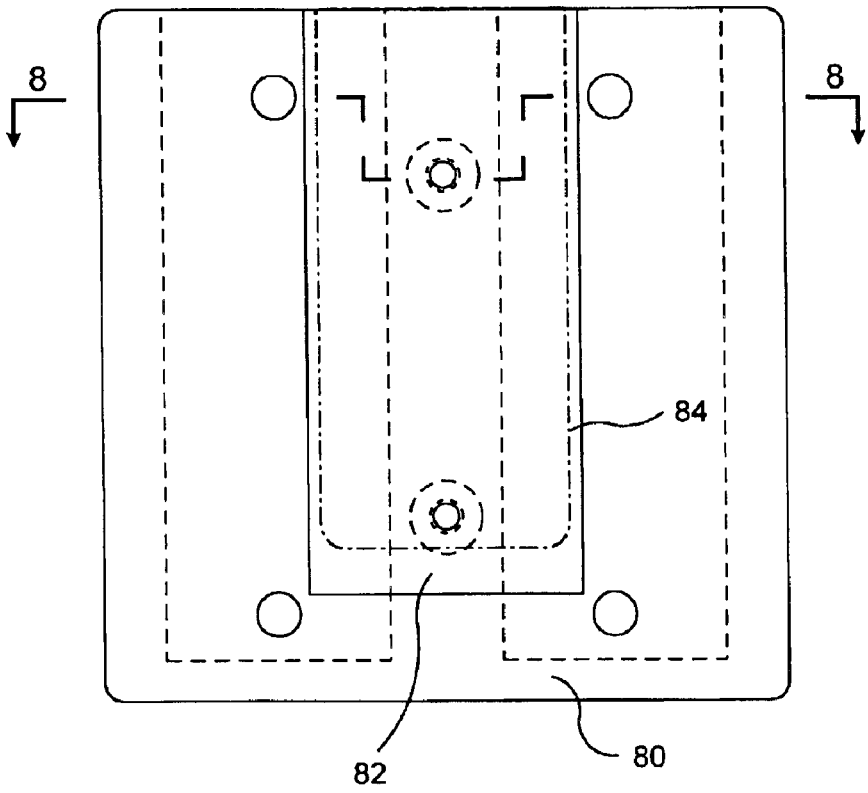
FIG. 7 is a front view of the multi-cavity device of FIG. 4.
Figure 8:
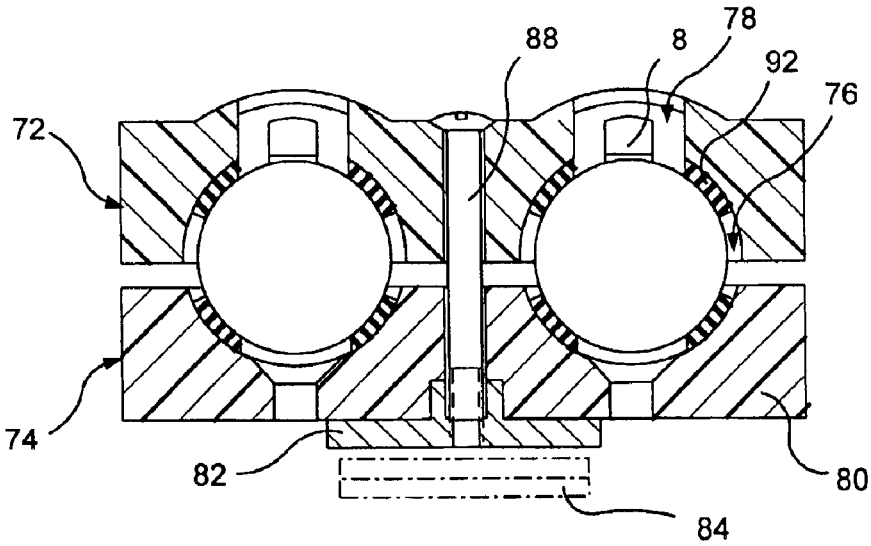
FIG. 8 is a cross-section view taken along stepped cutting plane 8—8 in FIG. 7.
Figure 9:
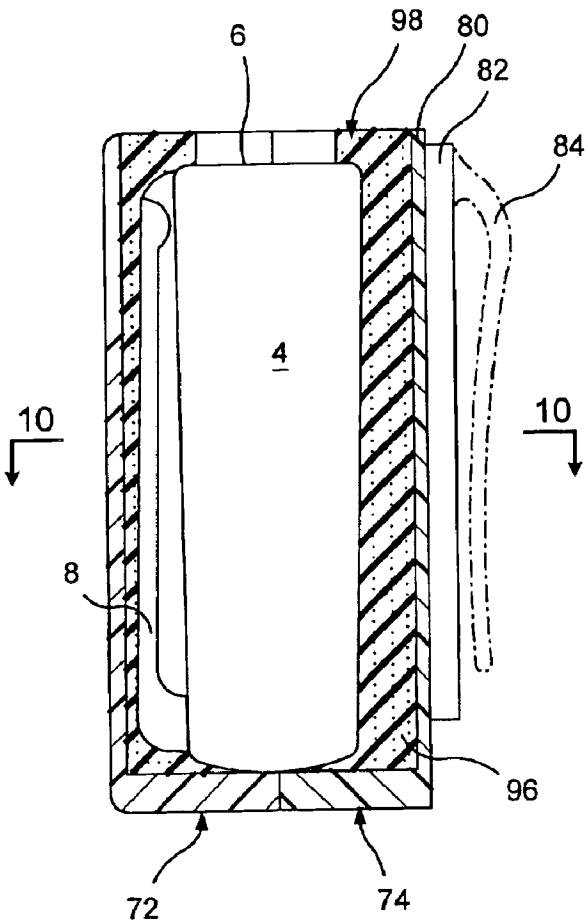
FIG. 9 is a partial section view (taken along cutting plane 9—9 in FIG. 10) of a multi-cavity marker pen holding device incorporating resilient cavity sleeves in accordance with a further aspect of the present invention.

As best depicted in FIGS. 6, 8 and 10, a clamping arrangement is provided for adjusting the relative positions of front and rear bodies 72 and 74. Substantially planar clamp body 82 is provided engaging rear wall 80 of rear body 74, such that integral tapped bosses 86 extend into corresponding recesses in rear body 74. Shoulder screws 88 having threaded distal end portions 90 threadingly engage the tapped bosses 86 in order to enable the aforementioned adjustment of front and rear bodies 72 and 74. In this manner, the pressure applied against the interposed marker caps can be easily adjusted using a conventional screwdriver.

A clip portion 84 can also be provided extending from the rear surface of clamp member 82 for attachment to a convenient structure or surface. As will be apparent to those skilled in the art, myriad alternate means for attaching clamp member 82 to a supporting structure or surface are possible without departing from the intended scope of the invention.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A device for supporting and holding a marker having a protective mating marker cap, the cap having a pocket attachment clip spaced from and extending longitudinally along an exterior surface of the marker cap, the device comprising:

a main body having a longitudinally extending receiving cavity consisting of a principal cavity portion adapted to accommodate said marker cap therein and an auxiliary cavity portion adapted for at least partially receiving said pocket attachment clip; and an attachment clip-retention arrangement for resealably retaining the marker cap within said cavity, said attachment clip-retention arrangement having at least one aperture formed within said body and adapted to accommodate at least one securing member, said at least one aperture having a central axis positioned at an angle to longitudinal axes of said principal and auxiliary cavity portions.

2. A device as recited in claim 1, wherein the auxiliary cavity portion further comprises a longitudinally extending channel sized and shaped for capturing the marker cap pocket attachment clip in a manner limiting rotation of the marker cap about its longitudinal axis and maintaining the cap in a predetermined desired orientation.

3. A device as recited in claim 1, wherein said cap retention arrangement further comprises a resilient insert at least partially covering said receiving cavity and configured for frictionally engaging the marker cap.

4. A device as recited in claim 3, wherein said resilient insert further comprises an upper lip configured for extending over an edge surrounding a marker-receiving opening of said marker cap body.

5. A device as recited in claim 1, wherein said main body further comprises first and second main structural body portions configured for releasable attachment to each other.

6. A device as recited in claim 5, wherein said first and second main body portions further comprise cooperating snap fit structures for enabling said releasable attachment.

7. A device as recited in claim 1, further comprising attachment arrangement for fixedly attaching the main body to a support surface, said attachment means further includes means for securing said main body to a supporting surface.

8. A device as recited in claim 7, wherein said attachment arrangement further comprises at least one mechanical fastener extending through an aperture in a sidewall of said main body.

9. A device as recited in claim 7, wherein said attachment means further comprises an adhesive disposed on an exterior surface of said main body.

10. A device as recited in claim 1, wherein said main body includes at least one side wall and said securing member is a securing pin extending through said at least one aperture formed within said at least one side wall.

11. A device as recited in claim 10, wherein said securing pin traverses a space between the exterior marker cap body surface and the pocket attachment clip.

12. A device as recited in claim 10, further comprising an arrangement for positional adjustment of said pin along the longitudinal axis of said principal cavity.

13. A device as recited in claim 12, wherein said positional adjustment arrangement further comprises a series of corresponding aligned aperture pairs provided in opposite side walls of said main body, each said aligned pair of apertures configured for receiving said securing pin therethrough.

14. A device for supporting and holding a marker having a protective mating cap having an exterior body surface and a pocket attachment clip spaced from and extending longitudinally along the exterior body surface, the device comprising:

a main body formed with a principal cavity portion adapted to accommodate the protective cap therein and an auxiliary cavity portion adapted for at least partially receiving the pocket attachment clip; and a securing member extending through said main body and traversing a space between the exterior body surface and the pocket attachment clip, so as to removably secure said cap within said main body to enable one-handed removal and insertion of the marker into and from the protective cap.

15. A device as recited in claim 14, wherein said securing member is a securing pin, and said main body further comprises at least one sidewall having at least one aperture extending therethrough, said at least one aperture having a central axis positioned at an angle to the longitudinal axes of said principal and auxiliary cavities.

16. A device as recited in claim 15, further comprising attachment arrangement for attaching the main body to a support surface.

17. A device for supporting and holding at least one marker having a protective mating cap including a pocket attachment clip on the exterior of a cap body, the device comprising:

a front body;

a rear body;

clamping arrangement adjustably securing said front body to said rear body;

said front and rear bodies cooperating to define at least one receiving cavity adapted for receiving the protective cap therebetween;

said at least one receiving cavity comprises a principal cavity portion for receiving said cap body and an auxiliary cavity portion for receiving said marker cap pocket attachment clip;

resilient means at least partially lining said cavity for frictionally engaging said mating cap; and said resilient means further comprises a lip portion configured for partially extending over an upper edge surrounding a marker-receiving opening of said cap body.

18. A device as recited in claim 17, wherein said clamping arrangement further comprising:

a clamping member engaging a rear surface of said rear body; and a mechanical fastener extending through aligned clearance apertures in said front and rear bodies and having a distal end threadingly engaging a tapped boss portion of said clamping member.

19. A device as recited in claim 17, further comprising an attachment arrangement for attaching said device to a supporting surface, said attachment arrangement further comprises a clip portion extending from a rear surface of a clamping member.

20. A device as recited in claim 17, wherein said at least one marker comprises a plurality of markers and said front and rear bodies cooperating to define a plurality of receiving cavities adapted for receiving a plurality of protective caps, said resilient means at least partially lining said cavities for frictionally engaging said mating caps.

* * * * *